US010905306B2

(12) United States Patent
Wong et al.

(10) Patent No.: US 10,905,306 B2
(45) Date of Patent: Feb. 2, 2021

(54) DISH WASHING MACHINE

(71) Applicants: Kwok Din Wong, Hong Kong (CN); Kam Por Chan, Hong Kong (CN)

(72) Inventors: Kwok Din Wong, Hong Kong (CN); Kam Por Chan, Hong Kong (CN)

(73) Assignee: Continental Clean Tech Limited, Hong Kong (CN)

( * ) Notice: Subject to any disclaimer, the term of this patent is extended or adjusted under 35 U.S.C. 154(b) by 885 days.

(21) Appl. No.: 15/455,536

(22) Filed: Mar. 10, 2017

(65) Prior Publication Data

US 2018/0256001 A1 Sep. 13, 2018

(51) Int. Cl.

| | |
|---|---|
| ***A47L 15/42*** | (2006.01) |
| ***A47L 15/00*** | (2006.01) |
| ***A47L 15/22*** | (2006.01) |
| ***E03C 1/184*** | (2006.01) |
| ***E03C 1/264*** | (2006.01) |
| *E03C 1/04* | (2006.01) |

(52) U.S. Cl.

CPC ..... *A47L 15/0078* (2013.01); *A47L 15/0005* (2013.01); *A47L 15/0007* (2013.01); *A47L 15/22* (2013.01); *A47L 15/4202* (2013.01); *A47L 15/4225* (2013.01); *A47L 15/4257* (2013.01); *A47L 15/4285* (2013.01); *E03C 1/184* (2013.01); *E03C 1/264* (2013.01); *E03C 1/0404* (2013.01)

(58) Field of Classification Search

None

See application file for complete search history.

(56) References Cited

U.S. PATENT DOCUMENTS 2,960,990 A 11/1960 Jones et al.
3,098,685 A 7/1963 Stiner et al.
(Continued)

FOREIGN PATENT DOCUMENTS

CN 1083692 A 3/1994
CN 1220129 A 6/1999
(Continued)

OTHER PUBLICATIONS

English machine translation of DE102005023429B2.*
(Continued)

*Primary Examiner* — Michael E Barr
*Assistant Examiner* — Jason P Riggleman
(74) *Attorney, Agent, or Firm* — Flynn Thiel, P.C.

(57) ABSTRACT

A dish washing machine including a cabinet having a frame defining a periphery of the dish washing machine, with the cabinet having a top, a front, a rear and a pair of sides. A dish washing area is located within the cabinet and includes a nozzle for spraying a liquid onto dishes in the dish washing area. The front of the cabinet has a door for allowing access into the dish washing area. A top wash basin is on the top of the cabinet, with the top wash basin including a spout for water and a sink for accepting liquid therein. The cabinet also can include a rinse detergent tank and a wash detergent tank, wherein a rinse detergent can be added to the rinse detergent tank and a wash detergent can be added to the wash detergent tank while the wash washing machine is activated.

25 Claims, 13 Drawing Sheets

(56) References Cited

U.S. PATENT DOCUMENTS

| | | | | | |
|---|---|---|---|---|---|
| 3,230,961 | A * | 1/1966 | Detterbeck | A47B 77/08 134/60 |
| 4,357,176 | A * | 11/1982 | Anthony | A47L 15/241 134/113 |
| 4,756,321 | A * | 7/1988 | Livingston | A47L 15/0055 134/56 D |
| 5,331,986 | A | 7/1994 | Lim et al. | |
| 5,453,131 | A | 9/1995 | Chan et al. | |
| 6,092,541 | A * | 7/2000 | Crane | A47B 77/02 134/88 |
| 6,401,499 | B1 * | 6/2002 | Clark | D06F 39/022 68/17 R |
| 9,078,555 | B2 | 7/2015 | Heisele et al. | |
| 2011/0185773 | A1 | 8/2011 | D'Andrea et al. | |

FOREIGN PATENT DOCUMENTS

| | | | |
|---|---|---|---|
| CN | 101229046 | A | 7/2008 |
| CN | 101961237 | A | 2/2011 |
| CN | 203524618 | U | 4/2014 |
| CN | 104939781 | A | 9/2015 |
| DE | 102005023429 | B2 * | 3/2007 |
| DE | 102009003015 | A1 | 12/2010 |
| GB | 575486 | * | 9/1944 |
| JP | 56-27235 | A | 3/1981 |
| JP | 10-75926 | A | 3/1998 |
| JP | 2001-292944 | A | 10/2001 |
| JP | 2007-7178 | A | 1/2007 |
| JP | 2009-89941 | A | 4/2009 |
| JP | 2009-131512 | A | 6/2009 |

OTHER PUBLICATIONS

Written Opinion of the International Searching Authority and International Search Report issued in PCT/CN2017/083098 dated Dec. 14, 2017 (12 pages).

European Search Report issued in corresponding European Application No. 17899749.0, dated Nov. 11, 2020 (8 pages).

* cited by examiner

DISH WASHING MACHINE

FIELD OF THE INVENTION

The present invention relates to dish washing machines, and in particular to dish washing machines with a compact profile having an integral sink and an easy system for supplying liquids to the dish washer.

BACKGROUND OF THE INVENTION

Commercial establishments for cooking and/or preparing food typically have a commercial dish washer for washing dirty dishes. The dish washers spray a detergent and water onto the dirty dishes to clean the dishes. The dish washers can also spray a rinse detergent and water onto the dishes after the dishes have been washed to rinse the dishes and prevent spots on the dishes.

Currently, there are four main types of commercial dish washers in worldwide markets. The commercial dish washers include an under-counter dish washing machine, a hood or door type dish washing machine, a tunnel type dish washing machine and a flight type dish washing machine. The under-counter dish washing machine has a small size and low profile and is positioned under a separate work bench with a wash basin next to the space occupied by the under-counter dish washing machine. The hood or door type dish washing machine, the tunnel type dish washing machine and the flight type dish washing machine all have a medium to large size and are positioned next to a separate side bench with a wash basin on the bench. The under-counter dish washing machine, the hood or door type dish washing machine and the tunnel type dish washing machine all typically use a rack or container having the dirty dishes that is positioned within the machine. The flight type dish washing machine has dishes that are put directly onto an integral conveyor and washed as the dishes pass therethrough.

Typically, commercial dish washing machines use a detergent, a sanitizer, and/or a drying agent in the dish washing process. Replaceable chemical drums are put near the machines, usually under the side bench. The chemicals are pumped into the dish washing machine and dispensed during the washing processes.

SUMMARY OF THE INVENTION

The present invention, according to one aspect, is directed to a dish washing machine comprising a cabinet including a frame defining a periphery of the dish washing machine, with the cabinet having a top, a front, a rear and a pair of sides. A dish washing area is within the cabinet, with the dish washing area including at least one spray nozzle for spraying a liquid onto dishes positioned within the dish washing area. The front of the cabinet has a door for allowing access into the dish washing area. A top wash basin is on the top of the cabinet, with the top wash basin including a spout for water and a sink for accepting liquid therein.

Another aspect of the present invention is to provide a dish washing machine comprising a cabinet including a frame defining a periphery of the dish washing machine, with the cabinet having a top, a front, a rear and a pair of sides. A dish washing area is within the cabinet, with the dish washing area including at least one spray nozzle for spraying a liquid onto dishes positioned within the dish washing area. A heating tank and a wash tank are within the cabinet, with the heating tank providing heated water to the wash tank for washing the dishes in the dish washing area. A wash pump provides the water in the wash tank to the at least one spray nozzle. A rinse pump provides the water in the heating tank to the at least one spray nozzle. A rinse detergent tank holds a rinse detergent and a rinse detergent pump provides the rinse detergent to the heating tank. A wash detergent tank holds a wash detergent and a wash detergent pump provides the wash detergent to the wash tank. The rinse detergent can be added to the rinse detergent tank while the rinse pump is activated. The wash detergent can be added to the wash detergent tank while the wash pump is activated.

Yet another aspect of the present invention is to provide a dish washing machine comprising a cabinet including a frame defining a periphery of the dish washing machine, with the cabinet having a top, a front, a rear and a pair of sides. A dish washing area is within the cabinet, with the dish washing area including at least one spray nozzle for spraying a liquid onto dishes positioned within the dish washing area. The front of the cabinet having a pivotable door for allowing access into the dish washing area. A heating tank and a wash tank are within the cabinet, with the heating tank providing heated water to the wash tank for washing the dishes in the dish washing area. A wash pump provides the water in the wash tank to the at least one spray nozzle. A rinse pump provides the water in the heating tank to the at least one spray nozzle. A rinse detergent tank holds a rinse detergent and a rinse detergent pump provides the rinse detergent to the heating tank. A wash detergent tank holds a wash detergent and a wash detergent pump provides the wash detergent to the wash tank. The rinse detergent can be added to the rinse detergent tank while the rinse pump is activated. The wash detergent can be added to the wash detergent tank while the wash pump is activated. A top wash basin is on the top of the cabinet, with the top wash basin including a spout for water and a sink for accepting liquid therein. The dish washing area has a washing drain for drainage of fluids within the dish washing area. The sink of the top wash basin has a basin drain for drainage of fluids within the sink. The liquid passing through the basin drain meets with the liquid passing through the washing drain.

BRIEF DESCRIPTION OF THE DRAWINGS

One or more embodiments of the present invention are illustrated by way of example and should not be construed as being limited to the specific embodiments depicted in the accompanying drawings, in which like reference numerals indicate similar elements.

Certain terminology will be used in the following description for convenience in reference only, and will not be limiting. Said terminology will include the words specifically mentioned, derivatives thereof, and words of similar import.

DETAILED DESCRIPTION

Figure 1:
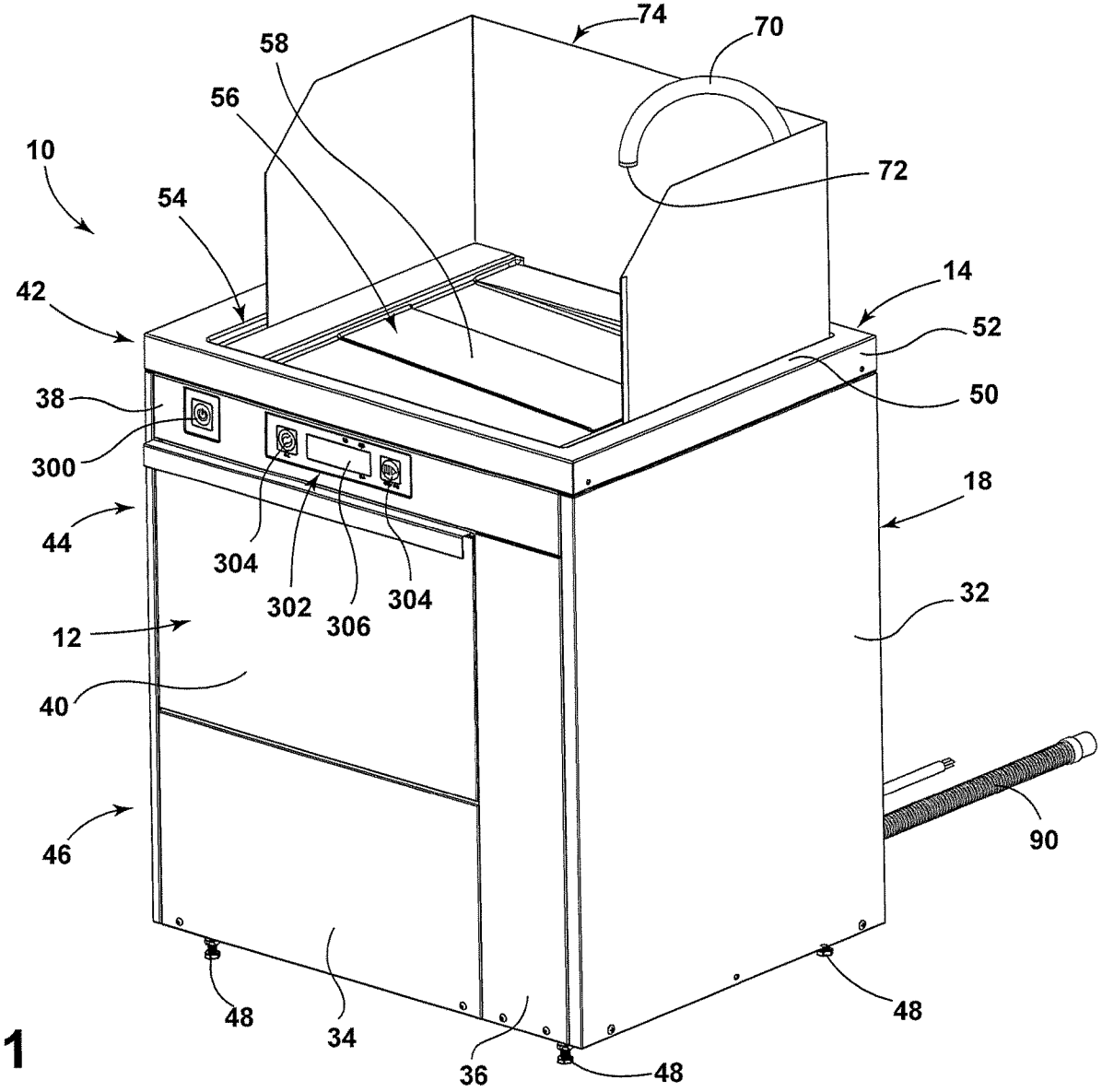
FIG. 1 is a first perspective view of a dish washing machine according to the invention.
Figure 2:
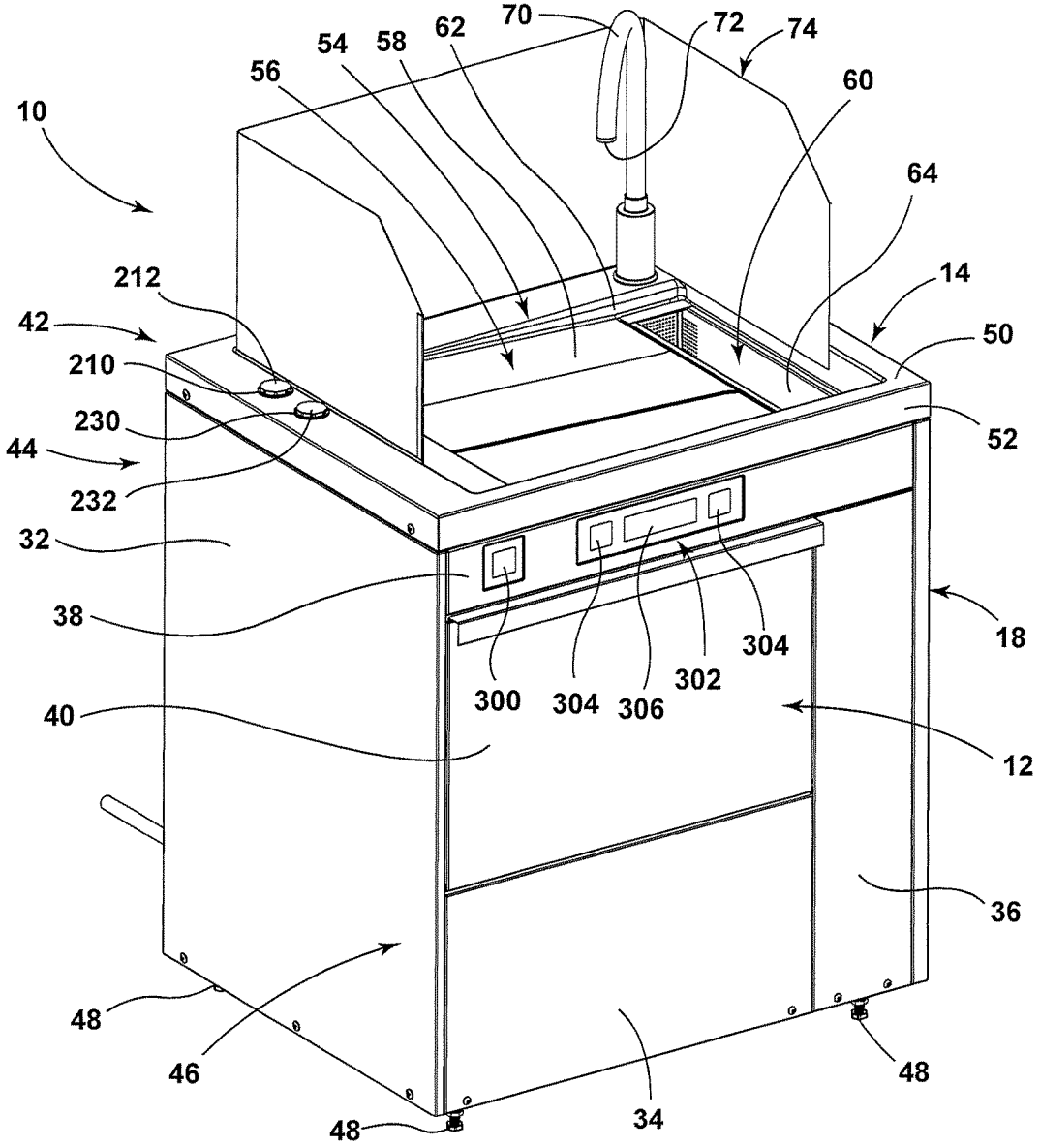
FIG. 2 is a second perspective view of the dish washing machine according to the invention.
Figure 3:
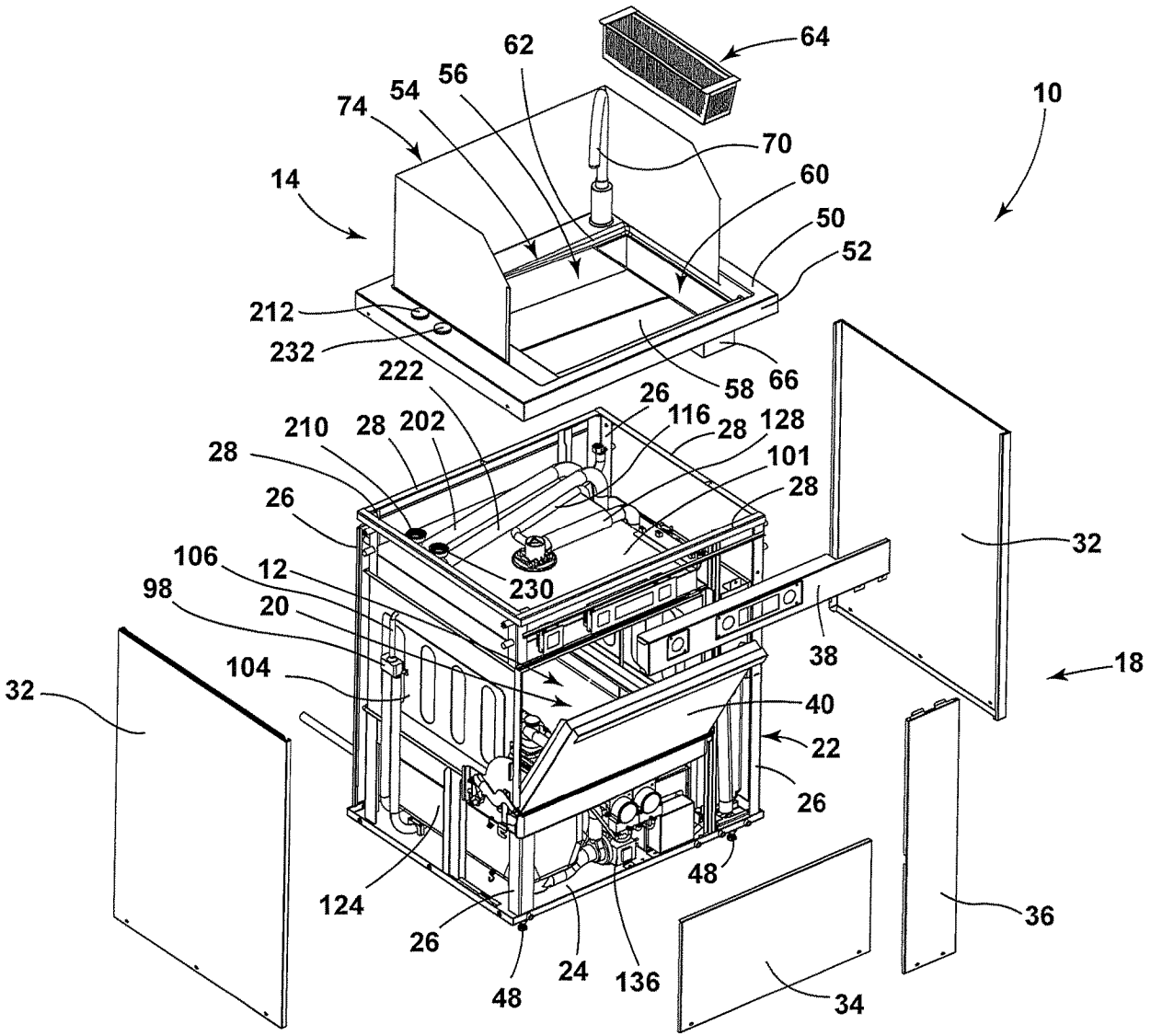
FIG. 3 is an exploded perspective view of the dish washing machine according to the invention.
Figure 4:
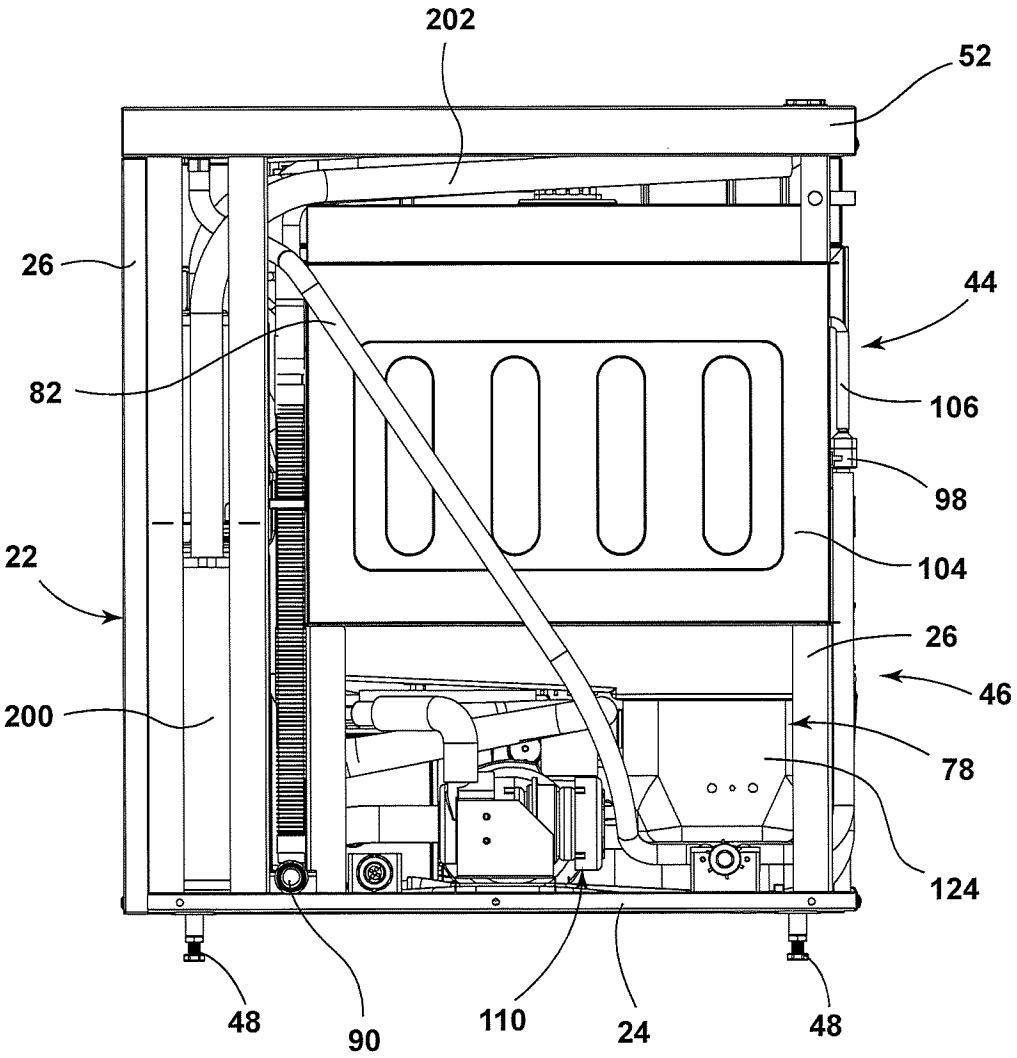
FIG. 4 is a rear view of the dish washing machine according to the invention with a top wash basin removed and the lines for suppling water for washing dishes removed.
Figure 5:
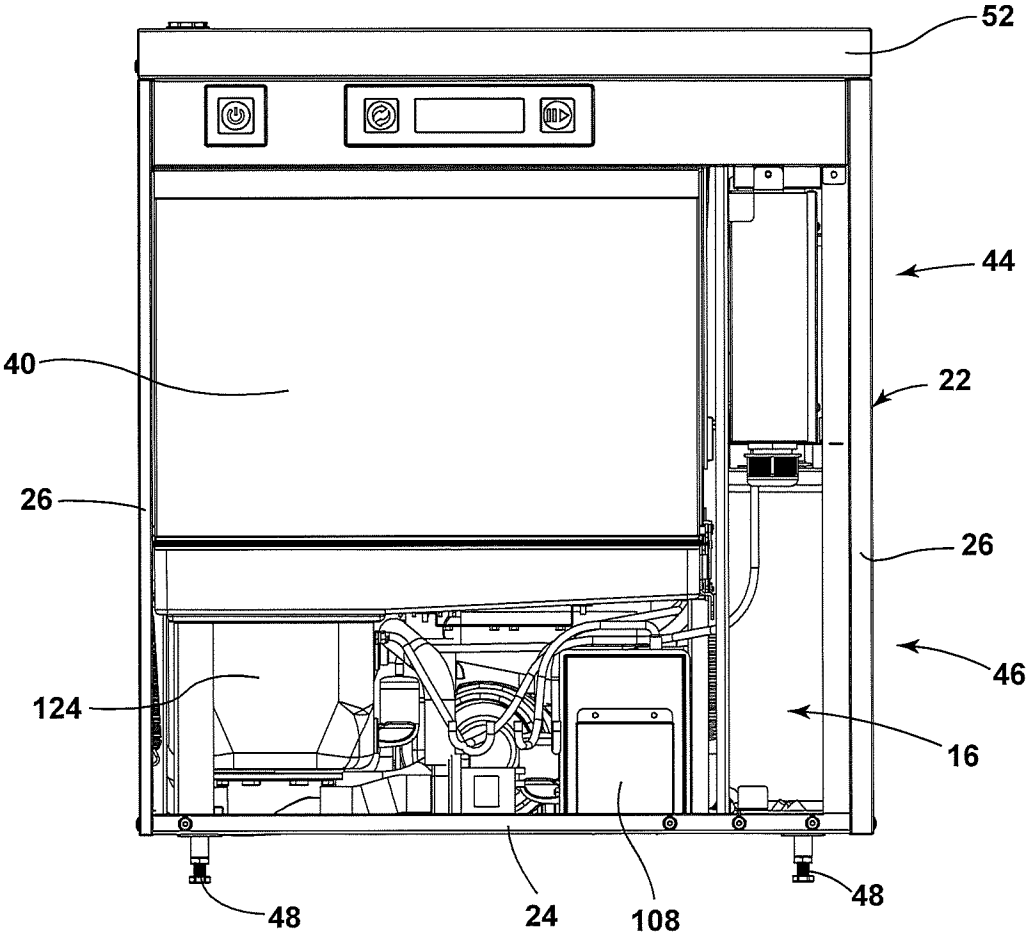
FIG. 5 is a front view of the dish washing machine according to the invention with the top wash basin and front panels removed.
Figure 6:
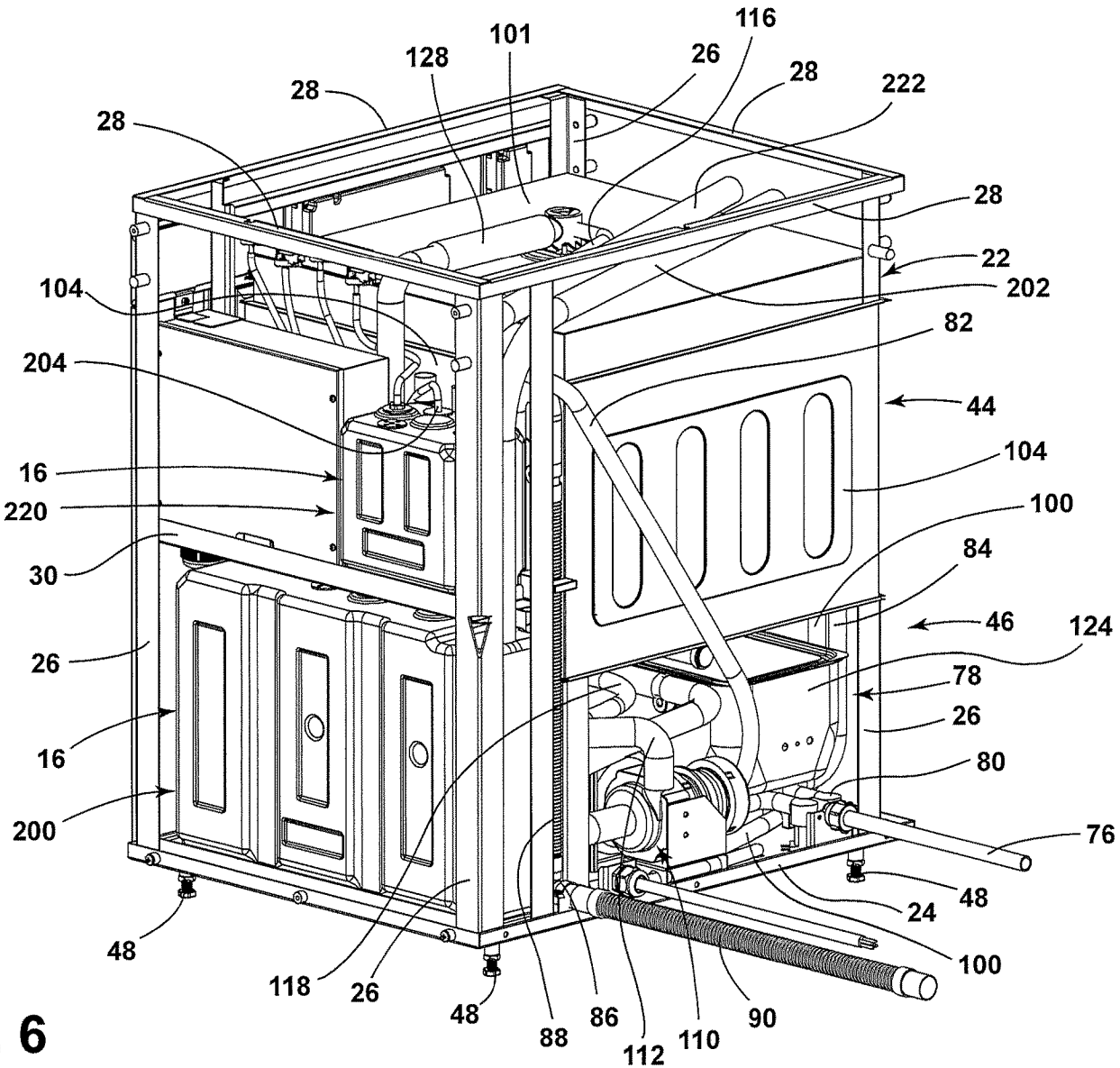
FIG. 6 is a rear perspective view of the dish washing machine according to the invention with the top wash basin and side panels removed.
Figure 7:
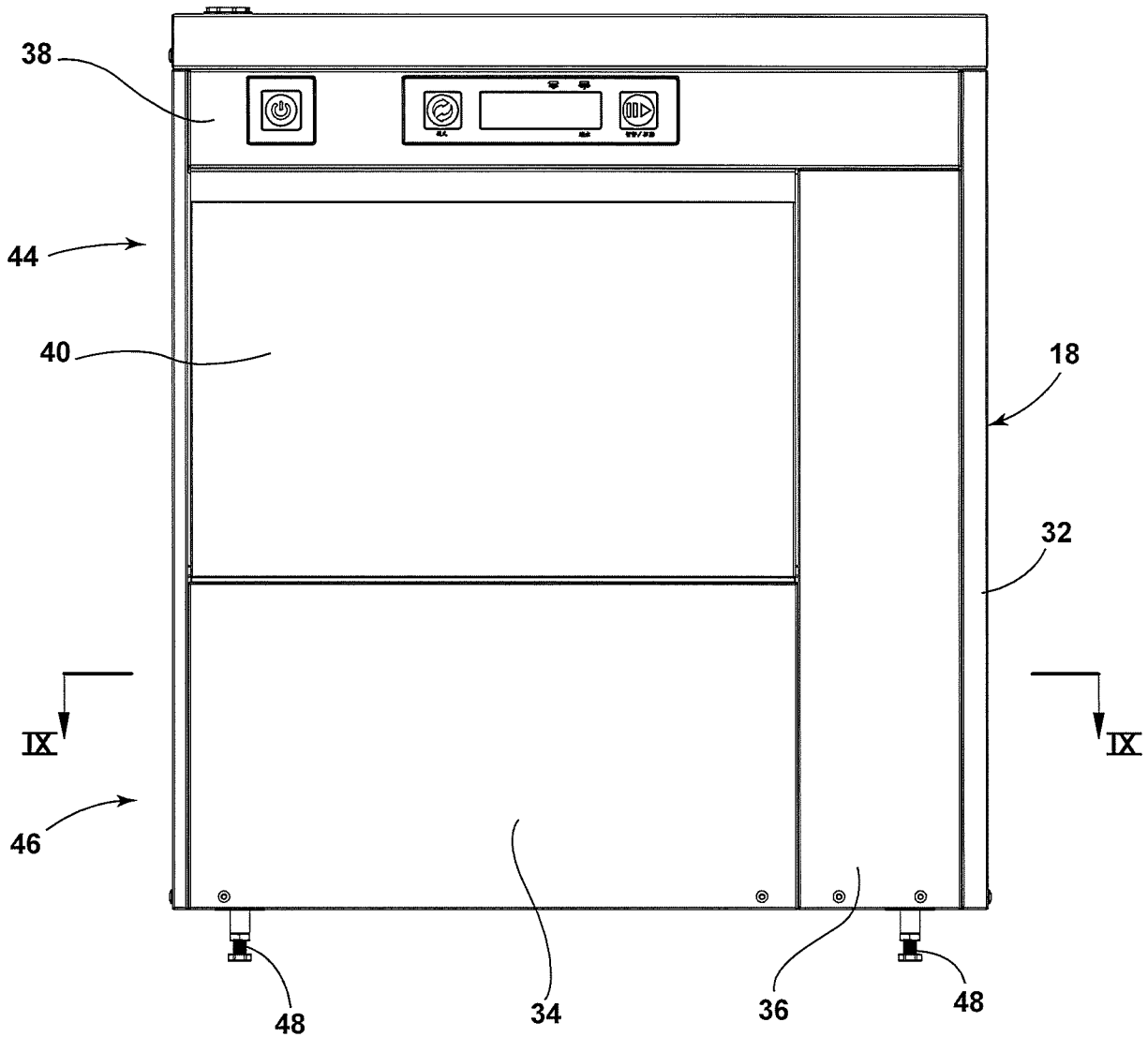
FIG. 7 is a front view of the dish washing machine according to the invention with the top wash basin removed.
Figure 8:
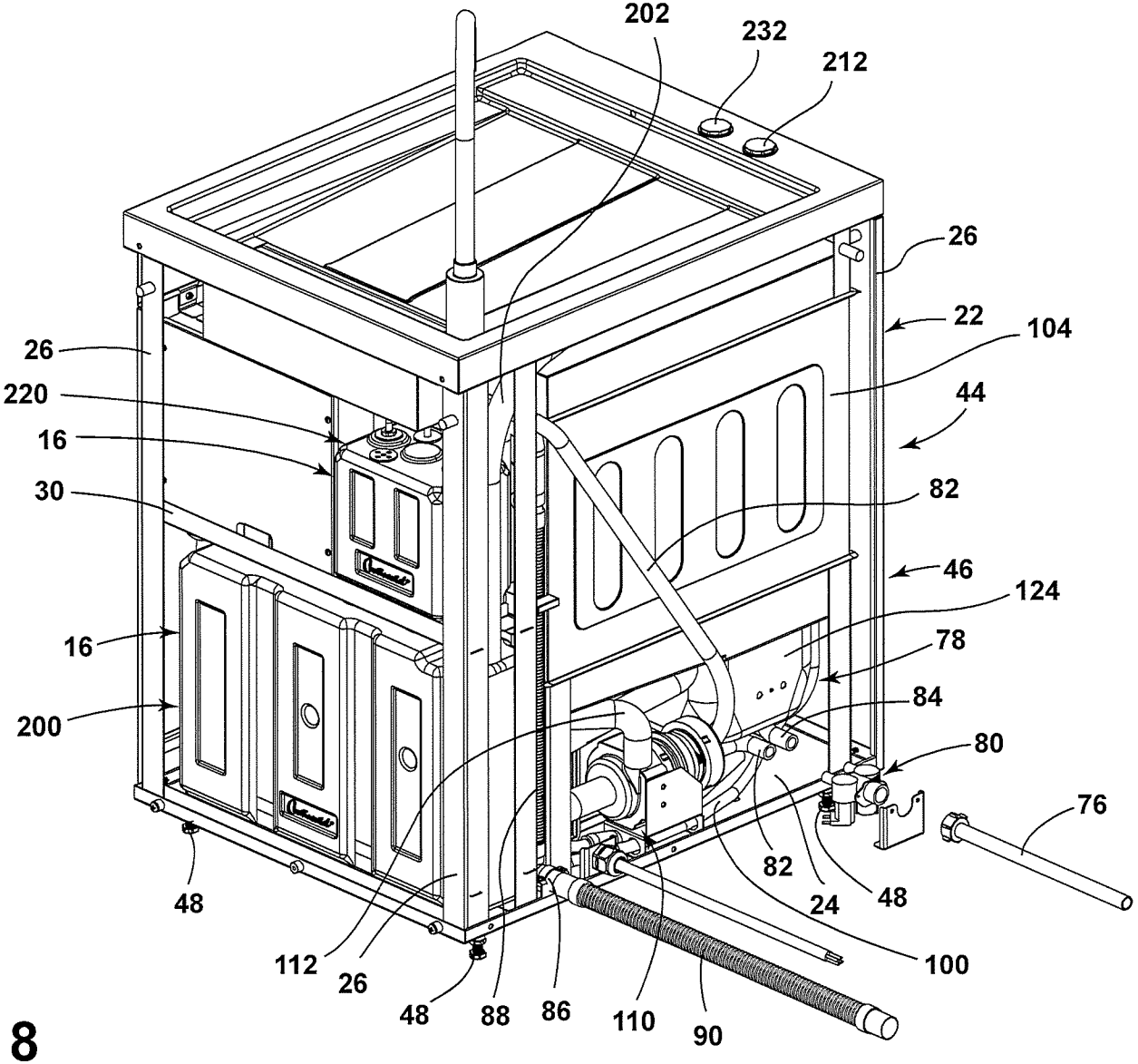
FIG. 8 is a rear perspective view of the dish washing machine according to the invention with a shield of the top wash basin and side panels removed.
Figure 9:
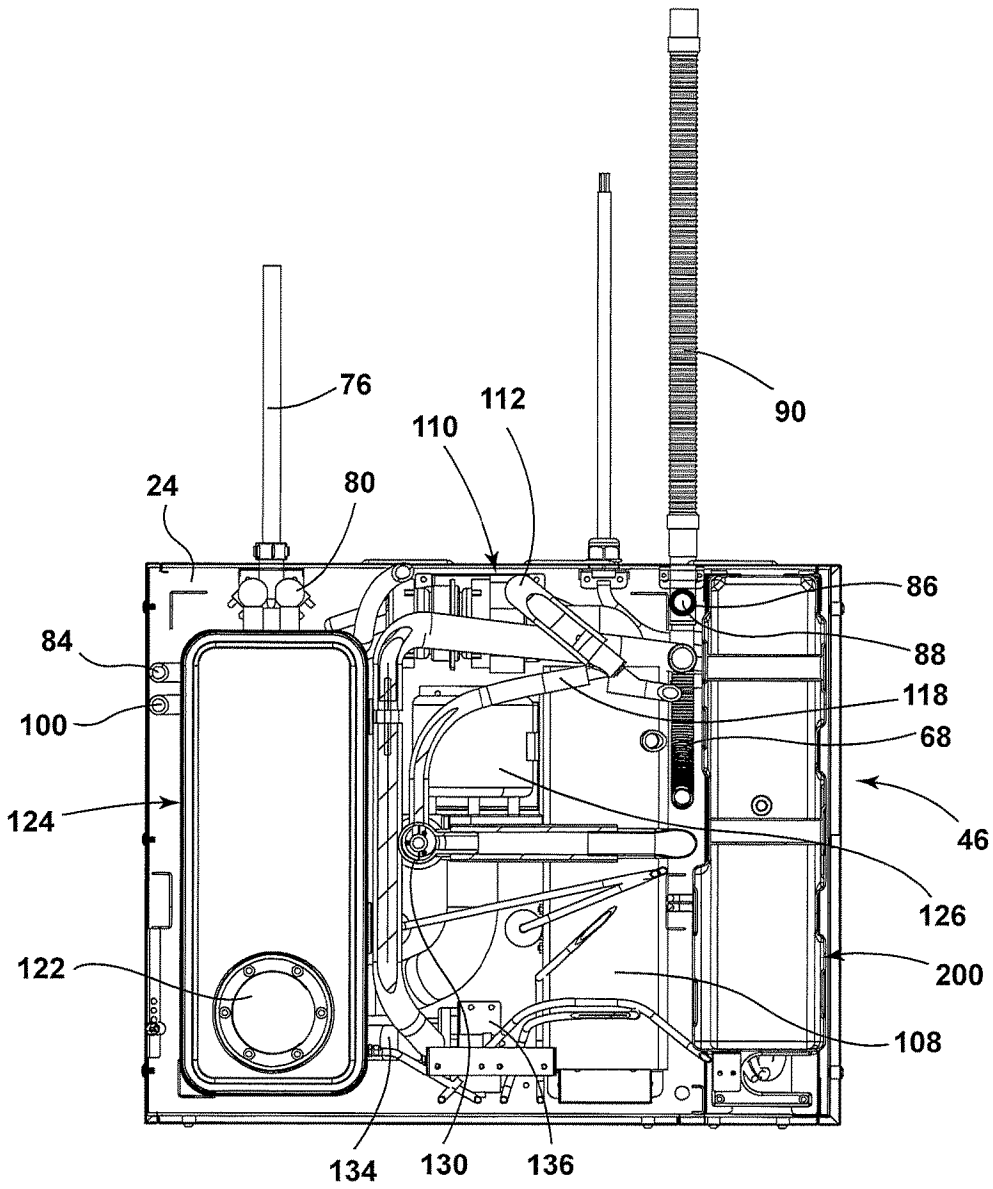
FIG. 9 is a cross-sectional view of the dish washing machine according to the invention taken along line IX-IX of FIG. 7.

FIGS. 1-2 illustrate a dish washing machine 10 including a dish washer 12 and an integral top wash basin 14. The integral top wash basin 14 allows the dish washing machine 10 to have a small profile along with a wash basin for allowing dishes to be washed or pre-washed before being placed within the dish washer 12. The dish washing machine 10 also includes storage tanks 16 for allowing cleaning and rinsing liquids to be easily and consistently supplied to the dish washer 12.

In the illustrated example, the dish washing machine 10 includes a cabinet 18 having the dish washer 12 and the integral top wash basin 14. The cabinet 18 defines an interior 20 with the dish washer 12 within the interior 20 and the top wash basin 14 at the top of the cabinet 18. The cabinet 18 includes a frame 22 having a bottom support plate 24, a plurality of corner posts 26, top cross bars 28 along a periphery of the frame 22 and connected to tops of the corner posts 26 and a plurality of intermediate cross bars 30 for providing rigidity to the frame 22. A pair of side panels 32, a front bottom panel 34, a front side vertical panel 36, a top display panel 38 and a pivotable front washer door 40 cover the interior 20 of the cabinet 22. The pivotable front washer door 40 is located above the front bottom panel 34, below the top display panel 38 and to the side of the front side vertical panel 36. It is contemplated that the frame 22, the panels 32, 34, 36 and 38, and the front washer door 40 could be made of any materials (e.g., metal or plastic). Furthermore, it is contemplated that the panels 32, 34, 36 and 38 can be easily removable from the frame 22 to allow access to the interior 20 of the cabinet 18. The cabinet 18 can include vertically adjustable feet 48 for adjusting a height of corners of the cabinet 18 and for levelling the cabinet 18. The cabinet 18 includes a top portion 42 having the top wash basin 14, a middle portion 44 including the dish washer 12 and a bottom portion 46 having mechanical features for running the dish washer 12.

The illustrated top portion 42 of the cabinet 18 includes the top wash basin 14 and allows for a user of the dish washing machine 10 to wash or pre-wash dishes. The top wash basin 14 includes a substantially rectangular peripheral panel 50 positioned on top of the top cross bars 28 of the frame 22 of the cabinet 18. The substantially peripheral panel 50 has a downwardly depending skirt 52 along a periphery thereof surrounding the top cross bars 28 of the frame 22. The peripheral panel 50 includes a central opening 54 defining a sink 56. The sink 56 includes a bottom angled plate 58, with a bottom side of the bottom angled plate 58 meeting a drain 60. The sink 56 also includes opposite triangular shaped side walls 62. The illustrated drain 60 is substantially rectangular and includes a removable strainer 64 held within a strainer holder 66. The strainer 64 is illustrated as having a rectangular cross-sectional shape and configured as a basket. However, it is contemplated that the strainer 64 could have any shape. The strainer 64 is configured to prevent large items (e.g., large pieces of food) from going down a drain pipe 68.

In the illustrated example, a water spout 70 is located adjacent the sink 56. The water spout 70 has an outlet 72 for water. It is contemplated that the spout 70 could be extendible/retractable and the outlet 72 can have a nozzle thereon for assisting in cleaning dishes. A U-shaped shield 74 flanks three sides of the sink 56 to maintain food, water and other liquids within an area above the top wash basin 14. The water spout 70 extends through the peripheral panel 50 between the sink 56 and the U-shaped shield 74.

Figure 13:
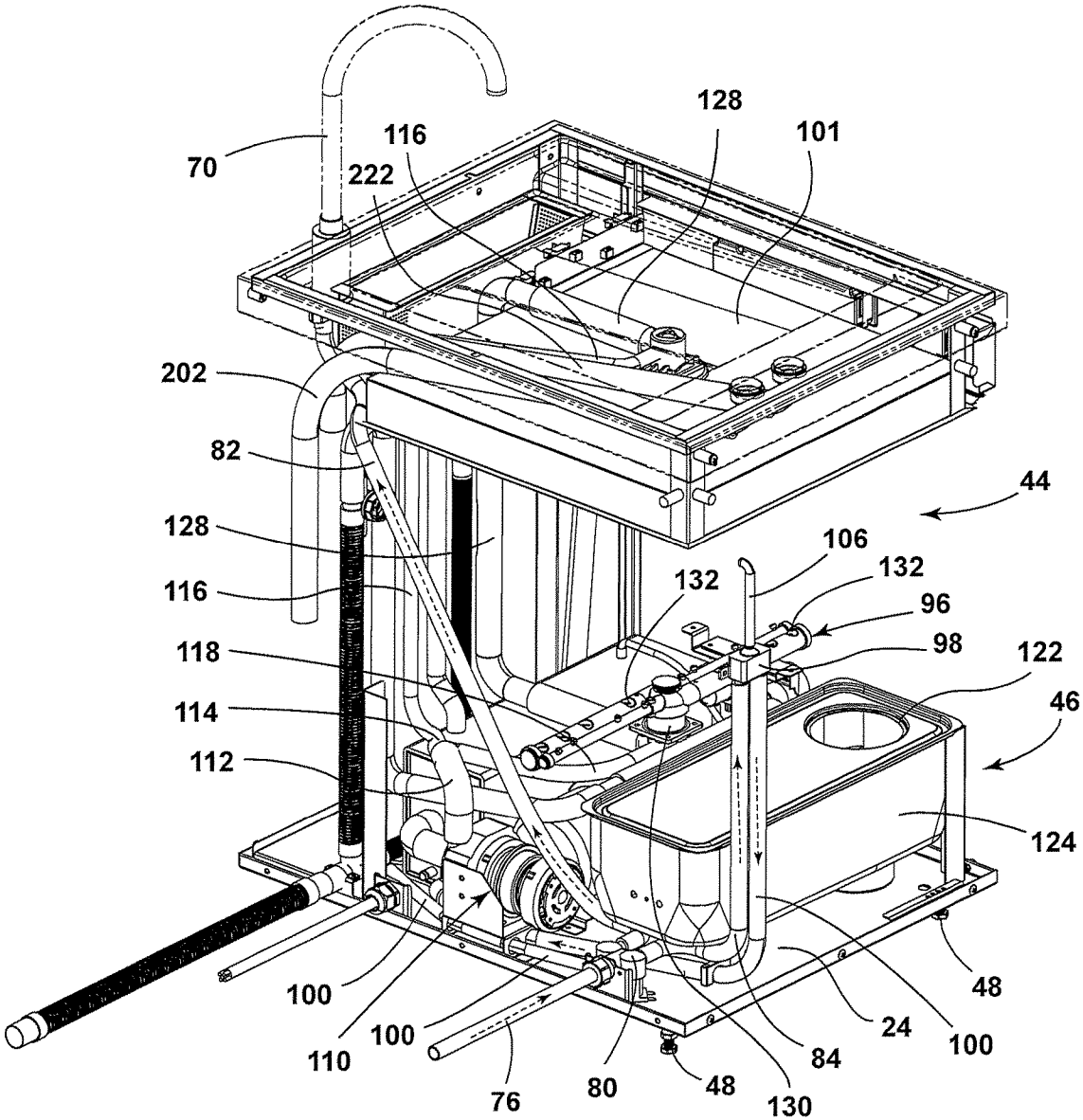
FIG. 13 is a rear perspective view of the dish washing machine according to the invention with several portions removed to show liquid flow paths of the dish washing machine.

In the illustrated example, water is provided to the spout 70 of the top wash basin 14 from an inlet line 76 for supplying fresh water (hot or cold) to the dish washing machine 10. The inlet line 76 enters the cabinet 18 of the dish washing machine 10 in a bottom open rear area 78 thereof. Once the inlet line 76 reaches the cabinet 18, a Y-fitting 80 (which can be a valve to divert the water into a selected output) splits the water into a spout line 82 and a washer line 84. The spout line 82 leads directly to the water spout 70 as illustrated in FIG. 13. The washer line 84 is used to supply water to the dish washer 12 as discussed in more detail below.

Figure 12:
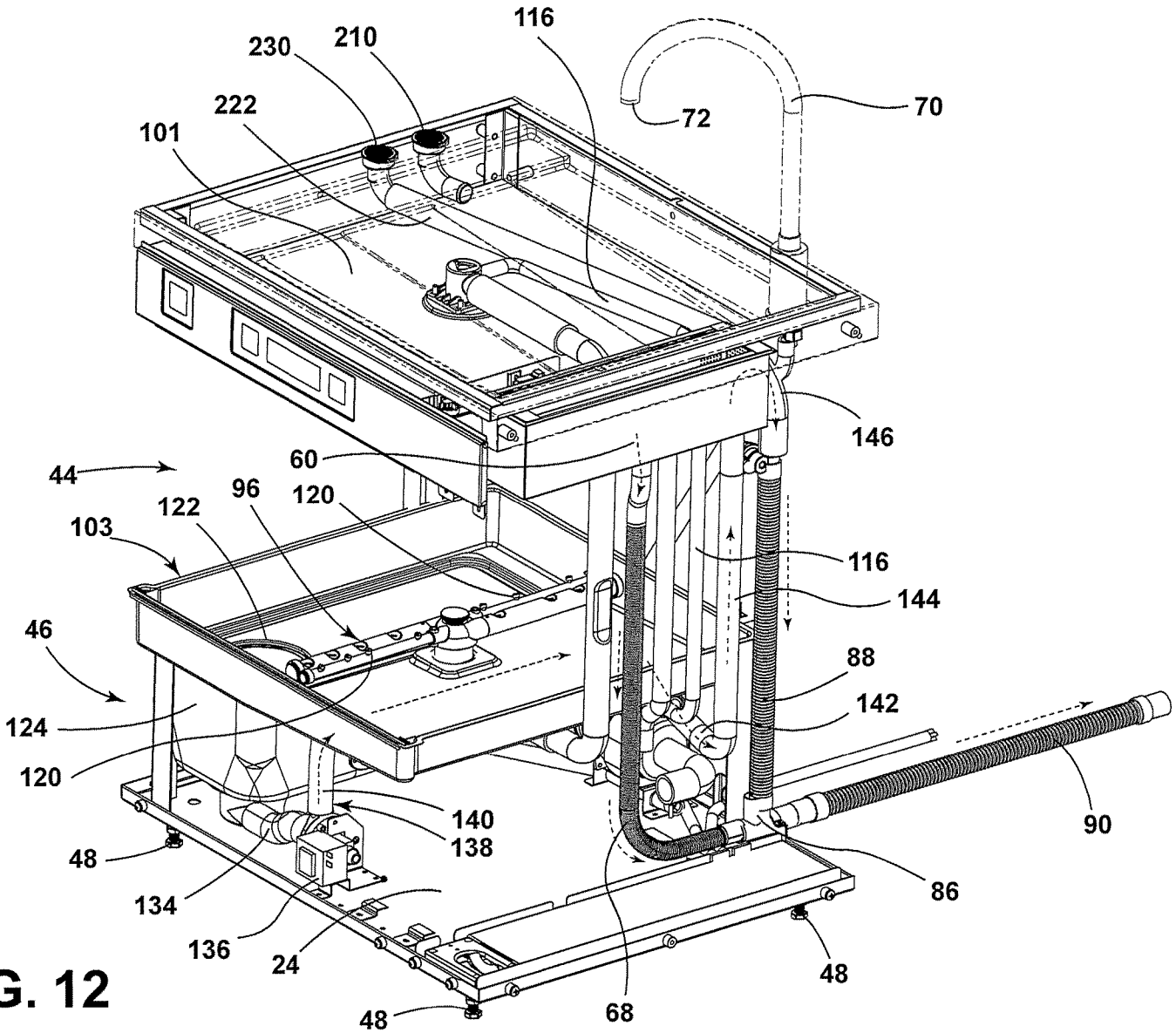
FIG. 12 is a side perspective view of the dish washing machine according to the invention with several portions removed to show liquid flow paths of the dish washing machine.

Small particles, water and/or other liquids pass through the strainer 64 of the top wash basin 14 to be drained away from the top wash basin 14 through the drain pipe 68. As illustrated in FIG. 12, the drain pipe 68 is located at a bottom of the drain 60. The small particles, water and/or other liquids that pass through the strainer 64 of the top wash basin 14 pass through the drain pipe 68, through a tee joint 86 (connected to the output from a washer outlet pipe 88 as discussed below) and is removed from the dish washing machine 10 out of a machine output line 90 that exits the cabinet 18 of the dish washing machine 10 through the bottom open rear area 78.

The illustrated dish washer 12 washes dishes placed therein. Dishes can be placed on a tray or rack (not shown) that fits within a wash space 102 defined by three walls 104 (see FIG. 10) within the interior 20 of the cabinet 18 and the pivotable front washer door 40. The wash space 102 also includes a top plate 101 and a bottom basin 103 to define the wash space 102 with the walls 104. The tray or rack can slide on a pair of slide plates 92 (see FIG. 10) for moving into and out of the dish washer 12. The pivotable front washer door 40 can pivot about a bottom thereof to allow the tray or rack to slide into and out of the wash space 102 of the dish washer 12, with the interior of the pivotable front washer door 40 providing support for the tray or rack when the tray or rack is slid out of the dish washer 12. A top rotating spray arm 94 located at a top of the wash space 102 of the dish washer 12 and above the tray or rack along with a bottom rotating spray arm 96 located at a bottom of the wash space 102 and below the tray or rack spray a washing fluid and a rinsing fluid onto the dishes to clean the dishes.

In the illustrated example, the washing fluid and the rinsing fluid comes at least partially from the water supplied to the dish washing machine through the inlet line 76. As outlined above, the inlet line 76 supplies water to the Y-fitting 80, which splits that water to flow through the spout line 82 and the washer line 80. As illustrated in FIG. 13, the washer line 80 is vertically orientated and ends at a safety valve 98 (e.g., an air gap valve). The washer line 80 is an input to the safety valve 98. A heating tank supply line 100 is the output from the safety valve 98. The safety valve 98 allows fluid to flow from the washer line 80 to the heating tank supply line 100. However, if fluid is forced up the heating tank supply line 100, the safety valve 98 prevents the forced fluid from entering the washer line 80 and forces the forced fluid into an escape line 106 that connects to one of the walls 104 of the wash space 102 to empty the forced fluid into the wash space 102, thereby preventing the forced fluid from spilling onto the floor or causing other messes or damage.

The illustrated water from the heating tank supply line 100 is prepared for washing by emptying into a booster heating tank 108 before being supplied to the wash space 102. Once in the heating tank 108, the water is heated to assist in cleaning the dishes. It is contemplated that the heating tank 108 can heat the water to about 85° C. or higher. It is contemplated that the system for washing dishes could measure the temperature of the water in the heating tank 108 before proceeding or the water could be heated in the heating tank 108 for a certain period of time before proceeding. After the water is heated in the heating tank 108, a rinse pump 110 sucks the water from the heating tank 108 into an initial rinse line 112 that splits at a Y-shaped rinse splitter 114 into an upper rinse line 116 and a lower rinse line 118. The upper rinse line 116 leads to a rinse path in the top rotating spray arm 94 and the lower rinse line 118 leads to a rinse path in the bottom rotating spray arm 96. The upper rinse line 116 and the lower rinse line 118 both have a one-way valve on an end thereof to prevent water from returning thereto. The heated water from the upper rinse line 116 and the lower rinse line 118 spray through rinse nozzles 120 in the top rotating spray arm 94 and the bottom rotating spray arm 96, respectively. After leaving the top rotating spray arm 94 and the bottom rotating spray arm 96, the heated water falls to the bottom basin 103 and flows through a bottom hole 122 therein into a wash tank 124.

In the illustrated example, once enough water pools into the wash tank 124, the wash process is ready to begin. First, a wash detergent is injected into the wash tank 124 to help with the cleaning of the dishes and the water in the wash tank is heated (e.g., to about 65° C. or higher). The path of the wash detergent into the wash tank 124 is discussed in more detail below. When the wash process is ready to begin, the rinse pump 110 is stopped. The wash process reuses the water in the wash tank 124. It is contemplated that wash detergent could be added to the wash tank 124 periodically or continually during the wash process. After the wash detergent is added to the water in the wash tank 124, a wash pump 126 forces the water in the wash tank 124 into an upper wash line 128 and a lower wash line 130. The upper wash line 128 leads to a wash path in the top rotating spray arm 94 and the lower wash line 130 leads to a wash path in the bottom rotating spray arm 96. The upper wash line 128 and the lower wash line 130 both have a one-way valve on an end thereof to prevent water from returning thereto. The washing water from the upper wash line 128 and the lower wash line 130 spray through wash nozzles 132 in the top rotating spray arm 94 and the bottom rotating spray arm 96, respectively. The force of the washing water leaving the wash nozzles 132 forces the top rotating spray arm 94 (spraying downward) and the bottom rotating spray arm 96 (spraying upward) to rotate as is well known to those skilled in the art. Eventually, the washing water falls to the bottom basin 103 and flows through the bottom hole 122 therein into the wash tank 124, wherein the process of pumping the washing water to the top rotating spray arm 94 and the bottom rotating spray arm 96 continuously occurs during the washing cycle.

After the illustrated washing cycle is complete, the washing water is removed from the dish washer 12. As illustrated in FIG. 12, a short discharge tube 134 is connected to the wash tank 124. A discharge pump 136 is connected to the short discharge tube 134 and prevents the washing water from passing any further than the discharge pump 136 during the washing cycle. However, once the washing cycle is complete, the wash pump 126 is deactivated to thereby no longer draw any of the washing water from the wash tank 124 and the discharge pump 136 is activated. The discharge pump 136 draws the washing water from the wash tank 124 and the short discharge tube 134 and sends the washing water through an expulsion line 138. The expulsion line 138 includes a short vertical tube 140 that stops below a bottom of the bottom basin 103, a horizontal L-shaped tube 142 that passes around internal components of the wash tank 124, a long vertical tube 144 that meets the L-shaped tube 142 and that is adjacent and substantially parallel to the washer outlet pipe 88, an inverted U-shaped tube 146, and the washer outlet pipe 88. Therefore, the washing water pumped by the discharge pump 136 through the expulsion line 138 enters the tee joint 86 and is removed from the dish washing machine 10 out of the machine output line 90.

In the illustrated example, after the dishes in the dish washer 12 have been washed, the dishes are rinsed. During the washing cycle, more water is supplied to the booster heating tank 108 from the heating tank supply line 100. Once in the heating tank 108, the water is heated to assist in rinsing the dishes. It is contemplated that the heating tank 108 can heat the water to about 85° C. or higher. It is contemplated that the system for washing dishes could measure the temperature of the water in the heating tank 108 before proceeding or the water could be heated in the heating tank 108 for a certain period of time before proceeding. During, before or after the water is heated in the heating tank 108, a rinse wash detergent is injected into the heating tank 108 to help with the rinsing of the dishes. The path of the rinse detergent into the heating tank 108 is discussed in more detail below. After the rinse water is heated and the rinse detergent is added thereto, the rinse pump 110 sucks the rinse water from the heating tank 108 into the initial rinse line 112 that splits the rinse water at the Y-shaped rinse splitter 114 into the upper rinse line 116 and the lower rinse line 118. The upper rinse line 116 leads to the rinse path in the top rotating spray arm 94 and the lower rinse line 118 leads to the rinse path in the bottom rotating spray arm 96. The heated rinse water from the upper rinse line 116 and the lower rinse line 118 spray through the rinse nozzles 120 in the top rotating spray arm 94 and the bottom rotating spray arm 96, respectively. After leaving the top rotating spray arm 94 and the bottom rotating spray arm 96, the heated rinse water falls to the bottom basin 103 and flows through the bottom hole 122 therein into the wash tank 124. Heated rinse water is continuously supplied to the top rotating spray arm 94 and the lower rinse line 118 for a certain period of time to rinse the dishes. After the certain period of time is complete, the dishes are completely washed and can be removed from the dish washer.

The illustrated rinse water in the wash tank 124 is removed from the wash tank 124 and pumped to the outlet line 90 in the same manner as the washing water is pumped from the wash tank 124 to the outlet line 90. Even though the pumping of the washing water and the rinse water from the wash tank 124 is described as happening in two steps (i.e., the washer water and then the rinse water is pumped from the wash tank 124), it is contemplated that the rinsing of the dishes can take place directly after the washing cycle such that a mixture of the washing water and the rinsing water is pumped from the wash tank 124 to the outlet line 90. Furhtermore, it is contemplated that not all wash water and rinse water are drained away from the wash tank 124 after each wash cycle. The dish washing machine 10 could include a control system that monitors an inlet valve for the fresh water from the inlet line 76 and the amount of water removed using the discharge pump 136. The dish washing machine 10 can use the information related to the amount of fresh water input into the system and the amount of wash water removed from the system along with level sensors in the wash tank 124 and the heating tank 108 to match the amount of fresh water input into the system with the amount of wash water removed from the system to thereby provide a stable amount of water in each of the wash tank 124 and the heating tank 108.

As outlined above, a wash detergent is added to the wash water in the wash tank 124 before and/or during the washing cycle. The wash detergent is located in a wash detergent tank 200 (which is one of the storage tanks 16). As illustrated in FIGS. 5, 6 and 8-11, the wash detergent tank 200 is located on the bottom support plate 24 of the frame 22 of the cabinet 18 behind the front side vertical panel 36 and inside of the side panel 32. The wash detergent tank 200 includes a wash detergent input line 202 for supplying wash detergent to the wash detergent tank 200. The wash detergent input line 202 extends to the peripheral panel 50 of the top wash basin 12 and includes a wash detergent insertion hole 210 wherein wash detergent can be poured into the wash detergent input line 202 to fill the wash detergent tank 200. A wash detergent cap 212 is removably connected to the wash detergent input line 202 at the wash detergent insertion hole 210.

To add wash detergent to the wash tank 124 in the illustrated example, a wash detergent pump 206 (e.g., a peristaltic pump) suctions the wash detergent out of the wash detergent tank 200 through a wash detergent output line 204. After passing through the wash detergent pump 206, the wash detergent passes through a wash detergent entrance line 208 and into the wash tank 124.

As outlined above, a rinse detergent is added to the rinse water in the heating tank 108 before and/or during the rinse cycle. The rinse detergent is located in a rinse detergent tank 220 (which is one of the storage tanks 16). As illustrated in FIGS. 5, 6 and 8-11, the rinse detergent tank 220 is located on a middle support plate of the frame 22 of the cabinet 18 behind the front side vertical panel 36 and inside of the side panel 32. The rinse detergent tank 220 includes a rinse detergent input line 222 for supplying rinse detergent to the rinse detergent tank 220. The rinse detergent input line 222 extends to the peripheral panel 50 of the top wash basin 12 and includes a rinse detergent insertion hole 230 wherein rinse detergent can be poured into the rinse detergent input line 222 to fill the rinse detergent tank 220. A rinse detergent cap 232 is removably connected to the rinse detergent input line 222 at the rinse detergent insertion hole 230.

To add rinse detergent to the heating tank 108 in the illustrated example, a rinse detergent pump 226 (e.g., a peristaltic pump) suctions the rinse detergent out of the rinse detergent tank 220 through a rinse detergent output line 224. After passing through the rinse detergent pump 226, the rinse detergent passes through a rinse detergent entrance line 228 and into the heating tank 108.

Figure 10:
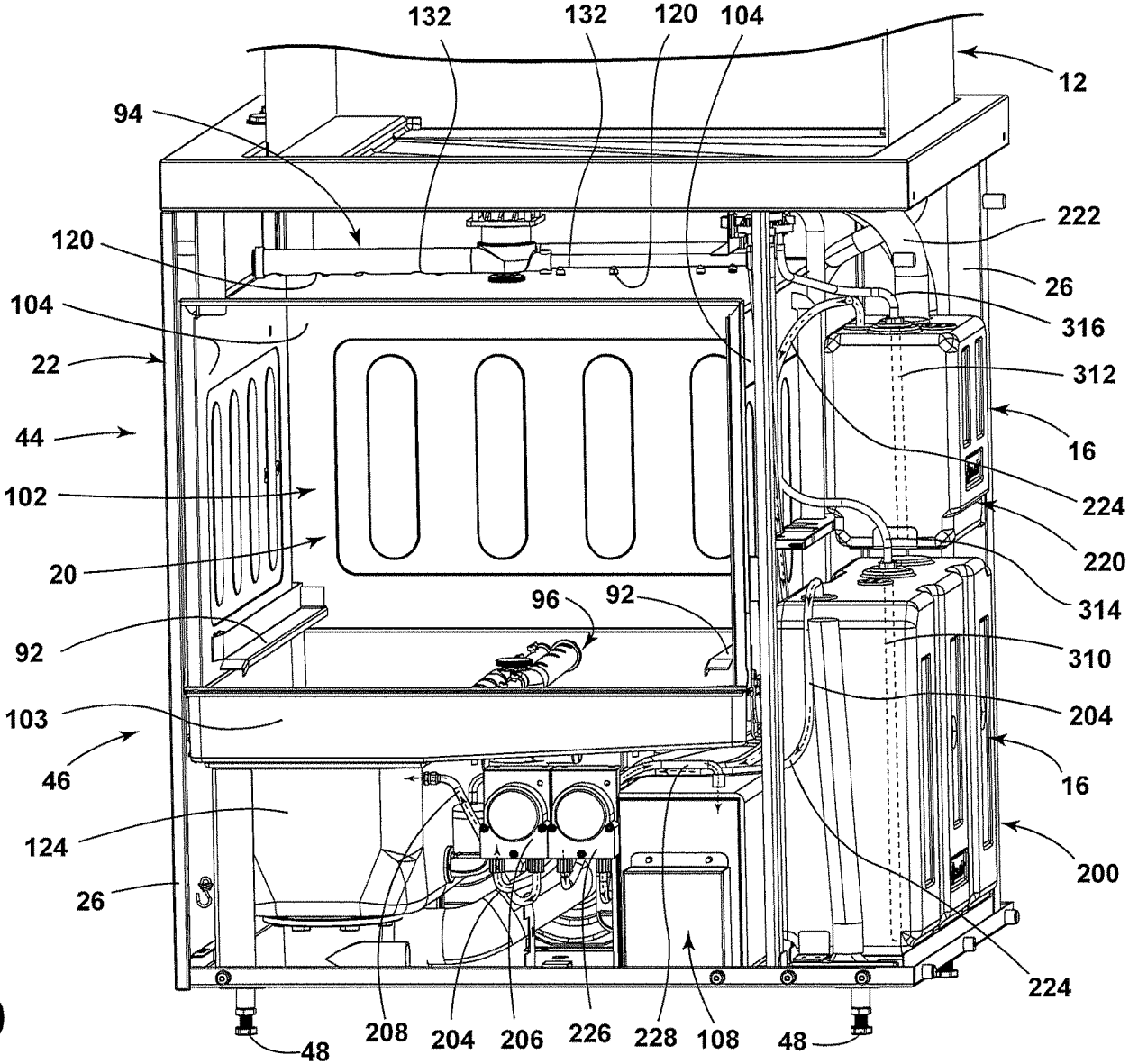
FIG. 10 is a partial front perspective view of the dish washing machine according to the invention with front and side panels and a dish washer removed.
Figure 11:
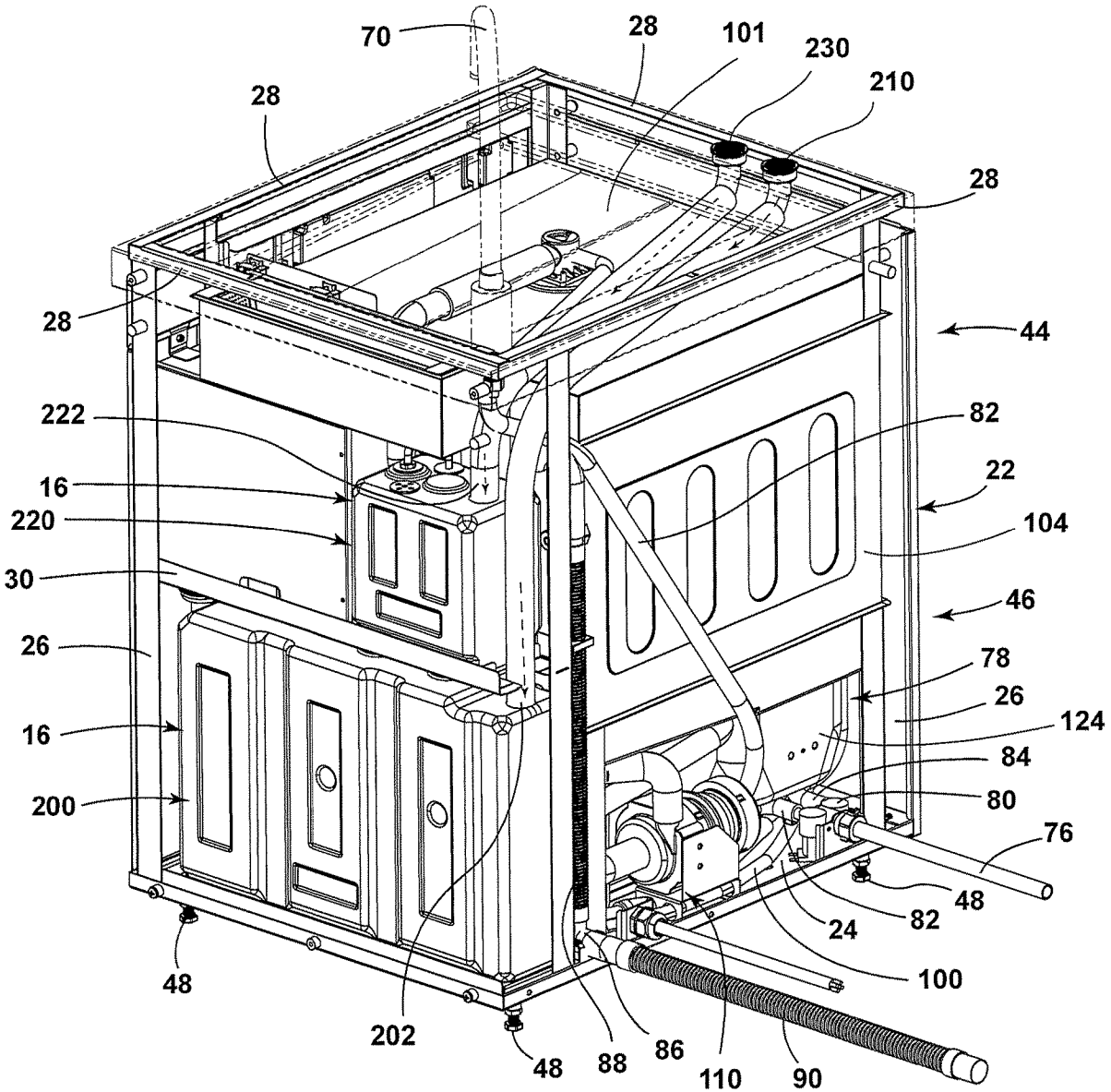
FIG. 11 is a rear perspective view of the dish washing machine according to the invention with portions of the top wash basin and side panels removed.

In the illustrated example, the rinse detergent and the wash detergent can be added to the system even while the wash cycle and/or the rinse cycle are active. As illustrated in FIG. 10, a wash detergent measurement system 310 (e.g., a float) within the wash detergent tank 200 communicates with a wash communication cable 314 that reports the amount of wash detergent in the wash detergent tank 200 or reports when the wash detergent tank 200 needs to be filled. As shown in FIG. 1, the top display panel 38 of the cabinet 38 includes a control panel 302 having controls 304 (e.g., to set timing or cycle types) and a display 306. The display 306 is connected to the wash communication cable 314 to visually communicate the amount of wash detergent in the wash detergent tank 200 or that more wash detergent needs to be added to the wash detergent tank 200. It is contemplated that the dish washing machine 10 could also provide further visual indication (e.g., a flashing light) or an auditory indication when more wash detergent needs to be added to the wash detergent tank 200. Likewise, a rinse detergent measurement system 312 (e.g., a float) within the rinse detergent tank 220 communicates with a rinse communication cable 316 that reports the amount of rinse detergent in the rinse detergent tank 220 or reports when the rinse detergent tank 220 needs to be filled. The display 306 is also connected to the rinse communication cable 316 to visually communicate the amount of rinse detergent in the rinse detergent tank 220 or that more rinse detergent needs to be added to the rinse detergent tank 220. It is contemplated that the dish washing machine 10 could also provide further visual indication (e.g., a flashing light) or an auditory indication when more rinse detergent needs to be added to the rinse detergent tank 220. The top display panel 38 of the cabinet 38 includes a power button 300. It is also contemplated that the dish washing machine 10 can provide visual and/or audio indication when each of the the wash detergent tank 200 and the rinse detergent tank 220 are full.

In the illustrated dish washing machine 10 as described above, the dish washing machine 10 can include a small footprint including both a dish washer 12 and a top wash basin 14 vertically aligned and in a single device. Therefore, the illustrated dish washing machine 10 as described above takes up less space in a commercial kitchen or other location. Moreover, the system for feeding wash detergent and rinse detergent to the dish washing machine allows for the system to continue to complete the wash cycle and/or the rinse cycle while a wash detergent and/or a rinse detergent is added to the system, thereby ensuring that all wash and rinse cycles can be completed even when the cycles begin with an insufficient amount of wash detergent and/or rinse detergent.

Although particular preferred embodiments of the invention have been disclosed in detail for illustrative purposes, it will be recognized that variations or modifications of the disclosed apparatus, including the rearrangement of parts, lie within the scope of the present invention. For example, it is contemplated that only a single rotating spray arm (upper or lower) could be used.

What is claimed is:

1. A dish washing machine comprising:

a cabinet including a frame defining a periphery of the dish washing machine, the cabinet having a top, a front, a rear and a pair of sides;

a dish washing area within the cabinet, the dish washing area including at least one spray nozzle for spraying a liquid onto dishes positioned within the dish washing area, the front of the cabinet having a door for allowing access into the dish washing area;

a top wash basin on the top of the cabinet, the top wash basin including a spout for water and a sink for accepting liquid therein;

a heating tank and a wash tank within the cabinet;

heated water in the heating tank being provided to the wash tank for washing the dishes in the dish washing area;

a first pump for providing the water in the wash tank to the at least one spray nozzle; and a second pump for providing the water in the heating tank to the at least one spray nozzle.

2. The dish washing machine of claim 1, wherein:

the dish washing area has a washing drain for drainage of fluids within the dish washing area; and the sink of the top wash basin has a basin drain for drainage of fluids within the sink;

the liquid passing through the basin drain meet with the liquid passing through the washing drain.

3. The dish washing machine of claim 2, wherein:

the washing drain and the basin drain converge into a machine drain, with the machine drain extending out of the cabinet.

4. The dish washing machine of claim 1, wherein:

the door is pivotable downward to allow access into the dish washing area.

5. The dish washing machine of claim 1, wherein:

the at least one spray nozzle is a plurality of spray nozzles located on a top rotating arm and a bottom rotating arm.

6. The dish washing machine of claim 1, wherein:

the top wash basin includes a vertical shield having at least two vertical sections with a vertical angle therebetween positioned about a portion of the sink.

7. The dish washing machine of claim 1, further including:

a rinse detergent tank holding a rinse detergent and a rinse detergent pump for providing the rinse detergent to the heating tank; and a wash detergent tank holding a wash detergent and a wash detergent pump for providing the wash detergent to the wash tank.

8. The dish washing machine of claim 7, wherein:

the rinse detergent is added to the rinse detergent tank while the second pump is activated; and the wash detergent is added to the wash detergent tank while the first pump is activated.

9. The dish washing machine of claim 8, wherein:

the top wash basin includes a rinse detergent opening and a wash detergent opening;

the cabinet includes a rinse detergent inlet tube connecting the rinse detergent opening to the rinse detergent tank; and the cabinet includes a wash detergent inlet tube connecting the wash detergent opening to the wash detergent tank.

10. The dish washing machine of claim 8, wherein:

the rinse detergent pump is activated while the second pump is activated; and the wash detergent pump is activated while the first pump is activated.

11. The dish washing machine of claim 7, further including:

a rinse detergent level sensor within the rinse detergent tank for sensing a rinse detergent level within the rinse detergent tank; and a wash detergent level sensor within the wash detergent tank for sensing a wash detergent level within the wash detergent tank.

12. The dish washing machine of claim 11, further including:

an indicator on the cabinet for indicating the rinse detergent level within the rinse detergent tank and the wash detergent level within the wash detergent tank.

13. A dish washing machine comprising:

a cabinet including a frame defining a periphery of the dish washing machine, the cabinet having a top, a front, a rear and a pair of sides;

a dish washing area within the cabinet, the dish washing area including at least one spray nozzle for spraying a liquid onto dishes positioned within the dish washing area;

a heating tank and a wash tank within the cabinet, heated water in the heating tank being provided to the wash tank for washing the dishes in the dish washing area;

a first pump for providing the water in the wash tank to the at least one spray nozzle;

a second pump for providing the water in the heating tank to the at least one spray nozzle;

a rinse detergent tank holding a rinse detergent and a rinse detergent pump for providing the rinse detergent to the heating tank; and a wash detergent tank holding a wash detergent and a wash detergent pump for providing the wash detergent to the wash tank;

wherein the rinse detergent can be added to the rinse detergent tank while the second pump is activated; and wherein the wash detergent can be added to the wash detergent tank while the first pump is activated.

14. The dish washing machine of claim 13, wherein:

the dish washing area has a washing drain for drainage of fluids within the dish washing area.

15. The dish washing machine of claim 13, wherein:

the front of the cabinet has a door for allowing access into the dish washing area, with the door being pivotable downward to allow access into the dish washing area.

16. The dish washing machine of claim 13, wherein:

the at least one spray nozzle is a plurality of spray nozzles located on a top rotating arm and a bottom rotating arm.

17. The dish washing machine of claim 13, wherein:

the cabinet includes a rinse detergent opening and a wash detergent opening;

the cabinet includes a rinse detergent inlet tube connecting the rinse detergent opening to the rinse detergent tank; and the cabinet includes a wash detergent inlet tube connecting the wash detergent opening to the wash detergent tank.

18. The dish washing machine of claim 17, wherein:

the rinse detergent pump is activated while the second pump is activated; and the wash detergent pump is activated while the first pump is activated.

19. The dish washing machine of claim 13, further including:

a rinse detergent level sensor within the rinse detergent tank for sensing a rinse detergent level within the rinse detergent tank; and a wash detergent level sensor within the wash detergent tank for sensing a wash detergent level within the wash detergent tank.

20. The dish washing machine of claim 19, further including:

an indicator on the cabinet for indicating the rinse detergent level within the rinse detergent tank and the wash detergent level within the wash detergent tank.

21. A dish washing machine comprising:

a cabinet including a frame defining a periphery of the dish washing machine, the cabinet having a top, a front, a rear and a pair of sides;

a dish washing area within the cabinet, the dish washing area including at least one spray nozzle for spraying a liquid onto dishes positioned within the dish washing area, the front of the cabinet having a pivotable door for allowing access into the dish washing area;

a heating tank and a wash tank within the cabinet, heated water in the heating tank being provided to the wash tank for washing the dishes in the dish washing area;

a first pump for providing the water in the wash tank to the at least one spray nozzle;

a second pump for providing the water in the heating tank to the at least one spray nozzle;

a rinse detergent tank holding a rinse detergent and a rinse detergent pump for providing the rinse detergent to the heating tank;

a wash detergent tank holding a wash detergent and a wash detergent pump for providing the wash detergent to the wash tank;

wherein the rinse detergent can be added to the rinse detergent tank while the second pump is activated; and wherein the wash detergent can be added to the wash detergent tank while the first pump is activated; and a top wash basin on the top of the cabinet, the top wash basin including a spout for water and a sink for accepting liquid therein;

the dish washing area has a washing drain for drainage of fluids within the dish washing area; and the sink of the top wash basin has a basin drain for drainage of fluids within the sink;

the liquid passing through the basin drain meet with the liquid passing through the washing drain.

22. The dish washing machine of claim 21, wherein:

the top wash basin includes a rinse detergent opening and a wash detergent opening;

the cabinet includes a rinse detergent inlet tube connecting the rinse detergent opening to the rinse detergent tank; and the cabinet includes a wash detergent inlet tube connecting the wash detergent opening to the wash detergent tank.

23. The dish washing machine of claim 21, wherein:

the rinse detergent pump can be activated while the second pump is activated; and wherein the wash detergent pump can be activated while the first pump is activated.

24. The dish washing machine of claim 21, further including:

a rinse detergent level sensor within the rinse detergent tank for sensing a rinse detergent level within the rinse detergent tank; and a wash detergent level sensor within the wash detergent tank for sensing a wash detergent level within the wash detergent tank.

25. The dish washing machine of claim 24, further including:

an indicator on the cabinet for indicating the rinse detergent level within the rinse detergent tank and the wash detergent level within the wash detergent tank.

* * * * *